US005989892A

United States Patent [19]

Nishimaki et al.

[11] Patent Number: 5,989,892

[45] Date of Patent: Nov. 23, 1999

[54] MICROORGANISMS, DEMULSIFIERS AND PROCESSES FOR BREAKING AN EMULSION

[75] Inventors: Fukumi Nishimaki; Nobuhiro Takahashi; Tomohiko Tsuchida; Kazuya Watanabe; Sanae Hino, all of Iruma-gun, Japan

[73] Assignee: Tonen Corporation, Tokyo, Japan

[21] Appl. No.: 08/662,944

[22] Filed: Jun. 13, 1996

[30] Foreign Application Priority Data

| | | | |
|---|---|---|---|
| Jun. 14, 1995 | [JP] | Japan | 7-147179 |
| Dec. 28, 1995 | [JP] | Japan | 7-343870 |
| Dec. 28, 1995 | [JP] | Japan | 7-343912 |

[51] Int. Cl.[6] ..... C02F 3/00; C12N 1/12; C12N 1/20

[52] U.S. Cl. ..... 435/252.1; 435/266; 210/610; 252/331

[58] Field of Search ..... 435/266, 252.1; 210/610; 252/331

[56] References Cited

U.S. PATENT DOCUMENTS

| | | | |
|---|---|---|---|
| 4,432,887 | 2/1984 | Zajic et al. | 252/331 |
| 5,328,689 | 7/1994 | Weiner et al. | 424/115 |
| 5,411,665 | 5/1995 | Scraggs et al. | 210/610 |
| 5,496,469 | 3/1996 | Scraggs et al. | 210/177 |
| 5,532,162 | 7/1996 | Aamot | 435/264 |

FOREIGN PATENT DOCUMENTS

| | | |
|---|---|---|
| 93-22403 | 11/1993 | WIPO . |
| 95-31408 | 11/1995 | WIPO . |

OTHER PUBLICATIONS

Duvnjak et al, Biotechnology Letters, 9(1), 39–42 (1987) "Deemulsificaaaation of Petroleum W/O . . . ".

Ramsay, B.A. et al, Microbial Enhanced Oil Recovery, pp. 61–65 (1983), Pennwell Books, U.S.A.

Cairns, W.L., et al, Applied and Environmental Microbiology, 43(2), 362–366(1982) "Characterization of . . . ".

Stewart, A.L., et al, Biotechnology Letters, 5(11), 725–730 (1983) "Bacteria–Induced . . . ".

Gray, N.C.C. et al, Biotechnology Letters, 6(7), 419–424 (1984) "Bacteria–Induced De–Emulsification . . . ".

Wilkinson, M.A., et al, Biotechnology Letters, 7(6), 406–408(1985) "Testing of Microbial . . . ".

Cairns, W.L., et al, Microbial Enhanced Oil Recovery, pp. 106–113(1983) Pennwell Books (USA).

Krug et al. Bugey's Manual of Systematic Bacteriology. vol. 1. Williams & Wilkins pp. 350–352, 1984.

*Primary Examiner*—John Ulm
*Assistant Examiner*—Christine Saoud
*Attorney, Agent, or Firm*—Michael N. Meller; Eugens Lieberstein

[57] ABSTRACT

The present invention discloses a process for breaking an emulsion comprising water and oil, comprising the steps of mixing an emulsion consisting of water and oil with a culture, bacterial cells or a culture supernatant of a bacterium belonging to the genus Alteromonas or the genus Rhodococcus capable of breaking an emulsion comprising water and oil; and consequently separating said emulsion into an aqueous layer and oil layer; and, a process for breaking an emulsion comprising water and oil, comprising the steps of mixing an emulsion comprising water and oil with bacterial cells of a bacterium belonging to the genus Aeromonas capable of breaking an emulsion comprising water and oil so as to form an aqueous layer and an aggregated layer consisting of bacterial cells and oil, and then separating these layers.

6 Claims, 16 Drawing Sheets

MICROORGANISMS, DEMULSIFIERS AND PROCESSES FOR BREAKING AN EMULSION

BACKGROUND OF THE INVENTION

1. Field of the Invention

The present invention relates to a process for breaking emulsions comprising water and oil using microorganisms, and to microorganisms used therefor.

2. Related Art

Complex water-in-oil (W/O) and oil-in-water (O/W) emulsions are generated in various petroleum recovery and refining process. Prior to further processing of the petroleum phase, the emulsions must be broken and aqueous layer separated from the oil. This separation is troublesome and difficult, so that destabilization of emulsions is a perpetual and costly problem for which better solutions are continuously sought.

W/O emulsions are generated during recovery and processing of petroleum crudes. Surfactants, steam and/or water is used to form an emulsion to improve the recovery rate as well as increase fluidity and movement. In an oil refining, stable emulsion are formed in a process to remove the moisture and highly concentrated salts contained therein.

O/W emulsions are generated from various stage, so that in the crude oil recovery process, the washing process of crude oil transport tankers and storage tanks, oil refining process and handling process for storage of petroleum products and so forth. In addition, excess amounts of industrial waste water emulsions are produced from food processing manufactures, dust control plants and oil handling factories. The industrial and domestic waste water may cause a severe environmental pollution. In addition to difficulties encountered in handling these emulsions due to their high viscosity, it is also difficult to treat these emulsions in the form of waste water. In order to treat emulsified waste water, it is first necessary to break emulsions and separate it into water and oil components.

In the case of carrying out a chemical reaction in a two-phase system consisting of an oil phase and a water phase, the formation of an emulsion by addition of surfactant is known in, for example, emulsion polymerization, and due to the considerable problems encountered when trying to remove the surfactant after reaction, the use of surfactant has been limited.

Moreover, in the case of bio-refining technology in which desulfurization, demetalization and denitrification and so forth are performed on crude oil and petroleum products by applying biotechnology, an emulsion is formed by biosurfactants produced by the microorganisms used. Although biosurfactants promote the bio-processing reactions, since there are serious problems encountered when trying to separate the oil and water components following completion of the reactions, effective means for breaking the emulsion have to be found. Various other means of solving these problems are being proposed in various ways depending on particular cases.

Processes for breaking emulsions known in the prior art include processes that use an inorganic or organic demulsifier, and processes that treat emulsions mechanically. An example of a process that uses an inorganic emulsion breaking agent is described in Japanese Unexamined Patent Publication No. 54-156268, which process uses an inorganic salt such as sodium chloride or potassium chloride. A process using a mixture of aluminum chloride and iron (III) chloride as a coagulating agent is described in Japanese Unexamined Patent Publication No. 50-116369, while a process using aluminum sulfate or iron chloride and so forth as coagulating agent is described in Japanese Unexamined Patent Publication No. 46-49899. In addition, Japanese Unexamined Patent Publication No. 46-33131 describes a process using ferric sulfate.

In addition, as an example of a process using an organic substance, Japanese Unexamined Patent Publication No. 54-10557 describes a process wherein an emulsion is broken by filtration after lowering the viscosity of the emulsion by using a polyoxyethylene alkylphenyl ether-based additive. On the other hand, as an example of mechanical treatment process, Japanese Unexamined Patent Publication No. 53-91462 describes a process wherein an emulsion is filtered by a filter having a demulsification function.

On the other hand, Japanese Unexamined Patent Publication No. 57-187098 describes a process wherein suspended solids including Kaolin clay are treated using microorganisms belonging to the genus Aeromonas after which COD, BOD and so forth are lowered by aggregation of those organic substances. In addition, a process wherein industrial waste water containing specific organic compounds is treated using microoraganisms belonging to the genus Aeromonas having an ability to assimilate and decompose said specific organic compounds are described in Japanese Unexamined Patent Publication No. 52-116647, Japanese Unexamined Patent Publication No. 52-11646, Japanese Unexamined Patent Publication No. 51-133954, and Japanese Unexamined Patent Publication No. 51-133475.

However, a process in which emulsions composed of water and oil are broken by using Alteromonas species bacteria, Rhodococcus species bacteria or Aeromonas species bacteria is not known in the prior art.

SUMMARY OF THE INVENTION

As described above, processes are known for breaking emulsions comprising water and oil use organic or inorganic coagulating agents, or use mechanical treatment. However, in the case of processes using a coagulating agent, a large amount of inorganic salt or organic substance remains in the waste water following treatment, causing pollution of the environment. In addition, removal of those substances requires considerable costs. In addition, in the case of mechanical treatment processes, an expensive apparatus to perform that treatment is required, thereby increasing the cost of waste liquid treatment.

Demulsifiers providing a particularly low level of environmental pollution are required to break emulsions in order to improve yield in crude oil recovery processes. Demulsifiers are also required that are harmless to microorganisms used in bio-processing in order to reuse under control of the formation and break of emulsion in bio-processes.

Thus, the present invention provides a process for breaking emulsions without causing environmental problems, at low cost and involving a simple process; a demulsifier therefor, and novel microorganisms having an ability to break emulsions.

Accordingly, the present invention provides a process for breaking an emulsion comprising water and oil, the process comprising mixing an emulsion comprising water and oil with a culture liquid or culture supernatant of a bacterium belonging to the genus Alteromonas or genus Rhodococcus, which are able to break emulsions consisting of water and oil, and consequently separating said emulsion into an aqueous layer and oil layer.

Moreover, the present invention provides a process for breaking an emulsion comprising water and oil, the process comprising mixing an emulsion comprising water and oil with a culture liquid or cells of a bacterium belonging to the genus Aeromonas which are able to break emulsions consisting of water and oil, consequently forming an aqueous layer and an aggregated layer comprising bacterial cells and oil, and then separating these layers.

DETAILED DESCRIPTION

Figure 1:
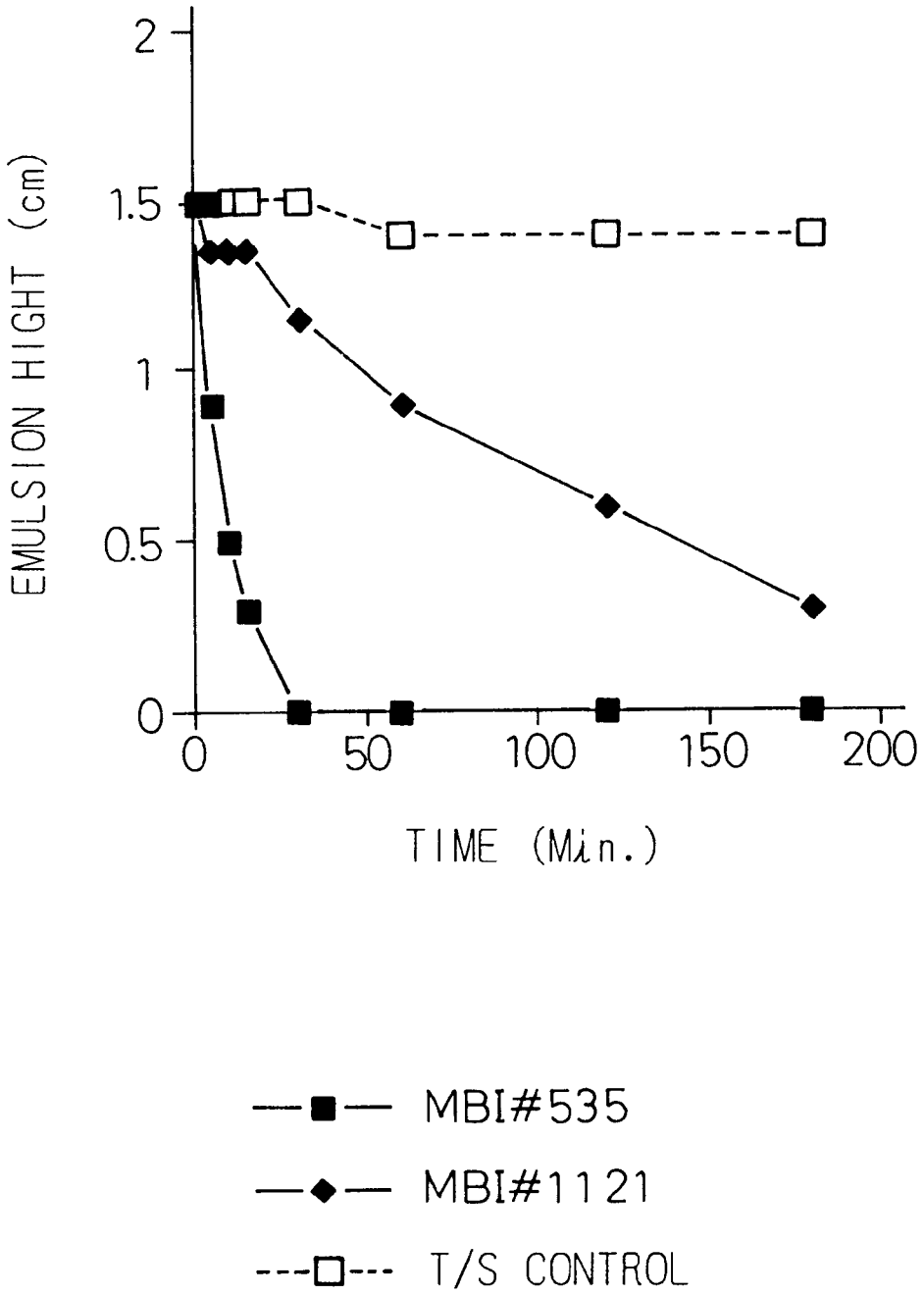
FIG. 1 is a graph showing the time course of demulsification of T/S emulsion by MBI #535 and MBI #1121 strains of the present invention.

The present invention can be broadly applied to emulsions produced in the form of waste water from various origins, including factories and homes. Examples of applications include emulsified waste water from food processing plants, emulsion waste water from dust control plants and emulsified waste liquid from cutting oil, hydraulic press oil and spindle oil.

Moreover, the present invention can be used for the efficient recovery of oil components from oil drilling process emulsions, crude oil transport tanker/storage tank washing emulsions and conventional petroleum refining emulsions (e.g. desalter emulsions), and for the separation of oil components, bacteria and moisture from petroleum bio-processing emulsions (e.g. bio-desulfurization processing emulsions, bio-demetalization processing emulsions and bio-chemical conversion processing emulsions) along with efficient recovery from them.

In addition, the present invention can also be applied for the separation of chemical reactants and emulsifiers of emulsion polymerization and so forth in oil-water biphasic systems. Emulsions may be of the oil in water type (O/W type) or of the water in oil type (W/O type). These are usually formed by means of surfactants. The present invention can be used to break these various types of emulsions. Furthermore, the mechanism by which Aeromonas and Alteromonas breaks kerosene emulsions and desalter emulsions may involve the surface activating substances in the emulsions being decomposed by lipase either secreted externally by Alteromonas and Aeromonas or present on the surface of the bacterial cells, thus resulting in demulsification.

According to the present invention, any of culture liquid, bacterial cells or culture supernatant can all be used provided they are of bacteria that belong to the genus Alteromonas or genus Rhodococcus that are able to break emulsions formed from water and oil. Furthermore, in the present invention, "culture" refers to a liquid obtained by culturing microorganisms; "bacterial cells" refers to bacterial cells obtained by removing liquid from a culture; and "supernatant" refers to a liquid present after removing bacterial cells from a culture.

Regarding Aeromonas, only bacterial cells thereof are active for demulsification of waste water, and both of bacterial cells and a culture supernatant are active for demulsification of kerosine emulsion.

Microorganisms used in the present invention can be obtained in, for example, the following manner. A desalter emulsion, a synthetic emulsion that imitates this, or an emulsion of kerosene and surfactants (Tween and Span) is formed, followed by the addition of a source for isolation of bacterium in which a desired bacterium is expected to be present, such as activated sludge, stored bacteria strains or seawater, and allowing to stand undisturbed for several minutes to 1 day at, for example, room temperature. Microorganisms that are able to break the emulsion as a result of the above operation can then be identified.

Next, the microorganisms obtained in this manner are cultured with shaking in a liquid medium. As a result, if a cultured microorganism has an ability to break the emulsion, the emulsion will disappear or decrease, and an aqueous layer and an oil layer will separate. A detailed description of this microorganism isolation is provided in Example 1.

Alternatively, microorganisms used in the present invention can also be isolated in the following manner. A waste water emulsion or synthetic emulsion that imitates it is solidified with agar to form an agar plate. Activated sludge or other source for isolation of bacteria, in which the desired bacteria is expected to be present, is then applied to the plate followed by incubation for 1 to 2 weeks at room temperature to 30° C. As a result, those microorganisms that are able to assimilate oil in an emulsion form colonies.

Next, the microorganisms obtained in this manner are cultured with shaking in a liquid medium containing emulsion. As a result, if a cultured microorganism has an ability to break the emulsion, the emulsion in the medium will disappear or decrease resulting in a decrease in the turbidity of the medium. Thus, by selecting those microorganisms in this medium that cause the turbidity of the medium to decrease, microorganisms can be obtained that have an ability to break emulsions. A detailed description of the isolation of microorganisms is provided in Example 7.

According to the present invention, a culture, bacterial cells or culture supernatant of a bacterium of the present invention may be added to and mixed with an emulsion to break the emulsion.

In order to obtain a culture, bacterial cells or a culture supernatant, it is preferable to culture a microorganism of the present invention in an ordinary medium, and preferably a liquid medium, containing a carbon source and nitrogen source, and preferably under aerobic conditions in accordance with a routine method such as aeration and/or agitation, or shaking, and so forth. Bacterial cells can be used in a form of a culture liquid itself, or only bacterial cells obtained by separating them from a culture can be used. In addition, a culture supernatant obtained by removing the bacterial cells can also be used. Commonly used bacterial cell separation techniques, including filtration and centrifugation, can be used for separating bacterial cells from a culture.

Bacterial cells or a culture supernatant used in the present invention may be dried or disrupted. Bacterial cells can be dried in accordance with routine methods such as spray drying, vacuum drying or freeze-drying. Dried bacterial cells are easily stored and convenient since they can be used as is when required.

Although the amount of bacterial cells used varies according to the origin of emulsion, the type and concentration of the oil component in the emulsion and so forth, in a process for separating an emulsion into an aqueous layer and oil layer using a microorganism belonging to the genus Alteromonas or genus Rhodococcus, for example, approximately 30 to 250 mg, and preferably 100 to 200 mg, of bacterial cells are used per kg of oil in the emulsion. In addition, in the case of supernatant, 30 to 250 ml, and preferably 100 to 200 ml, per kg of oil in the emulsion are used. Moreover, in the case of culture, 15 to 250 ml, and preferably 50 to 100 ml per kg of oil in the emulsion are used. In the case of using dried culture, dried bacterial cells, disrupted bacterial cells or dried supernatant, it is preferable to use the dried product or disrupted bacterial cells in an amount that is equivalent to the amount of the above-mentioned culture, bacterial cells or supernatant.

Demulsification is performed by mixing an emulsion to be treated with a culture, bacterial cells or with a supernatant, and then allowing to stand undisturbed. Demulsification is preferably performed at a room temperature to 40° C. for 1 minute to 1 day. Destabilization of an emulsion proceeds rapidly as soon as this procedure is started. Emulsion viscosity decreases rapidly in 1 minute to 1 hour, separation into an aqueous phase and oil phase begins and ultimately, the emulsion is separated into two layers, i.e., an oil layer and an aqueous layer.

The aqueous phase separated in this manner can be treated using ordinary waste liquid treatment methods. Alternatively, it can be allowed to run off as is or recycled for use as process water. On the other hand, the separated oil can be recovered by an isolator or oil separator and so forth.

Alternatively, in a process for separating an emulsion into an aqueous layer and a flocculated layer comprising bacterial cells and oil using a microorganism belonging to the genus Aeromonas, for example, although an amount of bacterial cells used varies according to the origin of emulsion, the type and concentration of oil in the emulsion and so forth, approximately 5 to 20 g, and preferably 5 to 10 g, of bacterial cells are used per kg of oil in the emulsion. In the case of using dried bacterial cells or dried disrupted bacterial cells as well, it is preferable that the dried bacterial cells or disrupted bacterial cells be used in an amount that is equivalent to the above-mentioned wet bacterial cells.

Demulsification is preferably performed while stirring, after mixing an emulsion to be treated with bacterial cells. Demulsification is preferably performed at room temperature to 35° C. for a few minutes to 1 day. It can be carried out over a pH range of 4 to 8. Separation of the emulsion proceeds rapidly when this procedure is started, the viscosity and turbidity of the emulsion rapidly decreases in a few minutes to 1 hour, after which separation begins into an aqueous phase and an aggregates of bacterial cells and oil. Since the aggregates floats on the aqueous phase, the aqueous phase and the aggregates can be separated by routine methods such as taking out the liquid phase from the bottom of the mixture or removal of the aggregates by centrifugation or filtration.

The aqueous phase separated in this manner can be treated using ordinary methods for waste water treatment. Alternatively, it can be allowed to run off as is or recycled for use as process water. On the other hand, the separated aggregates can be treated in accordance with routine methods such as incineration, or treated separately by further separating into bacterial cells and oil by a method such as centrifugation.

EXAMPLES The following provides a detailed explanation of the present invention through its examples.

EXAMPLE 1

Isolation of Microorganisms Having Demulsification Ability 50 ml of MBI medium (5 g peptone, 3 g beef extract, 1 g yeast extract, 1 g artificial seawater A, 20 ml of an artificial seawater mixture B and 1 liter distilled water) in a 200 ml—culture flask was inoculated with a source for isolation of microorganisms, in which bacterial cells are expected to be present, such as soil, activated sludge, seawater or stored bacteria, followed by incubating overnight at 30° C. while shaking at 150 rpm. The resulting bacterial cells or culture supernatant was used in the experiment. Bacterial cells were stored in 15% glycerol at −80° C.

Two types of kerosene emulsions were used for screening. These emulsions were prepared by mixing 2 ml of kerosene and 3 ml of surfactant and then stirring. One of the emulsions was referred to as "T/S emulsion". It contained two surfactants, 0.072% Tween 60 and 0.028% Span 60, and was an oil in water type (OW type) emulsion. Another emulsion was referred to as "L92 emulsion". It contained a surfactant, 0.1% Pluronic L92, and was an oil in water type (OW type) emulsion.

200 μl of the culture obtained by culturing as described above was added to test tubes containing one of the above-mentioned emulsions (5 ml), followed by stirring well and then allowing to stand undisturbed at a room temperature. The test tubes were then observed for demulsification. Since an emulsion layer decreases and separates into an aqueous layer and kerosene layer when demulsification occurs, a demulsification activity of the bacterial cells under test was determined by measuring the height of the emulsion layer. As a result, two strains, MBI #535 and MBI #1121, were obtained as bacterial strains that efficiently break the T/S kerosene emulsion. In addition, the two strains, MBI #1314 and MBI #1536, were obtained as bacterial strains that efficiently break the L92 kerosene emulsion.

Taxonomical properties of the above-mentioned bacterial strains are as shown in the following Tables 1 and 2.

TABLE 1

Taxonomical Properties of Strains MBI 535 and MBI 1121

| Bacterial strains | MBI 535 | MBI 1121 |
|---|---|---|
| Gram straining | − | − |
| Motility | + | + |
| Morphology | Rods | Rods |
| Catalase | + | + |
| Oxidase | + | + |
| Aerobic growth | + | + |
| Anaerobic growth | − | − |
| OF test | O | O |
| Marine base requirement | + | + |
| Pigment | + (yellow) | + (yellow/brown) |
| Acid generation | | |
| Glucose | + | + |
| Fructose | + | + |
| Maltose | + | + |
| Galactose | − | − |
| Xylose | − | − |
| Mannitol | − | − |
| Sucrose | + | + |
| Lactose | − | − |
| Glycerol | − | − |
| Esculin | − | − |
| Urease | − | − |
| Lipase | + | + |
| Assimilation | | |
| Nitrates | − | − |
| Lysine | − | − |
| Arginine | − | − |
| Ornithine | − | − |
| ONPG | − | − |
| Indole formation | − | − |
| Nitric acid reduction | − | − |
| Gelatinase | + | + |
| Coagulation | + | + |

TABLE 2

Taxonomical Properties of Strains MBI 1536 and MBI 1314

| Bacterial strains | MBI 1536 | MBI 1314 |
|---|---|---|
| Gram straining | + | − |
| Motility | − | + |
| Morphology | Rods/Cocci | Rods/Cocci |
| Mycelia | − | − |
| Catalase | + | + |
| Oxidase | − | − |
| Aerobic growth | + | + |
| Anaerobic growth | − | − |
| OF test | O | O |

TABLE 2-continued

Taxonomical Properties of Strains MBI 1536 and MBI 1314

| Bacterial strains | MBI 1536 | MBI 1314 |
|---|---|---|
| Acid fixation (?) | − | − |
| Pigment | + (orange) | + (orange) |
| Acid generation | | |
| Glucose | + | + |
| Fructose | + | + |
| Maltose | − | − |
| Galactose | − | − |
| Xylose | − | − |
| Mannitol | − | − |
| Sucrose | − | − |
| Lactose | − | − |
| Glycerol | − | − |
| Esculin | − | − |
| Urease | − | − |
| Assimilation | | |
| Nitrates | − | + |
| Lysine | − | − |
| Arginine | − | − |
| Ornithine | − | − |
| ONPG | − | − |
| Indole formation | − | − |
| Nitric acid reduction | − | − |
| Gelatinase | − | − |
| Penicillin | Sensitive | Sensitive |
| Lipase | − | − |

On the basis of the above results, when the bacterial strains were classified according to Bergey's Manual of Systematic Bacteriology, strains MBI #535 and MBI #1121 were named Alteromonas species, and strains MBI #1314 and MBI #1536 were named *Rhodococcus maris.*

Furthermore, the above-mentioned bacterial strain MBI #535 (Alteromonas sp.) was deposited under the name Alteromonas sp. MBI 535 as FERM P-1532; MBI #1121 (Alteromonas sp.) was deposited under the name Alteromonas sp. MBI 1121 as FERM P-15322; MBI #1314 (*Rhodococcus maris*) was deposited under the name *Rhodococcus maris* MBI 1314 as FERM P-15323; and MBI #1536 was deposited under the name *Rhodococcus maris* MBI 1536 as FERM P-15324, at the Institute of Bioengineering and Human Technology Agency of Industrial Science and Technology, on Dec. 4, 1995.

Furthermore, the above-mentioned microorganisms Alteromonas sp. MBI 535 (FERM P-1532) was transferred as FERM BP-5560, Alteromonas MBI 1121 (FERM P-15322) was transferred as FERM BP-5561, *Rhodococcus maris* MBI #1314 (FERM P-15323 was transferred as FERM BP-5562, and *Rhodococcus maris* MBI #1536 was transferred as FERM BP-5563, to international depositions under the Budapest Treaty on Jun. 5, 1996 at the National Institute of Bioscience and Human-Technology Agency of Industrial Science and Technology (1-1 Higashi 1-chome, Tsukuba-shi, Ibaraki-ken, Japan).

EXAMPLE 2

Demulsification

Figure 2:
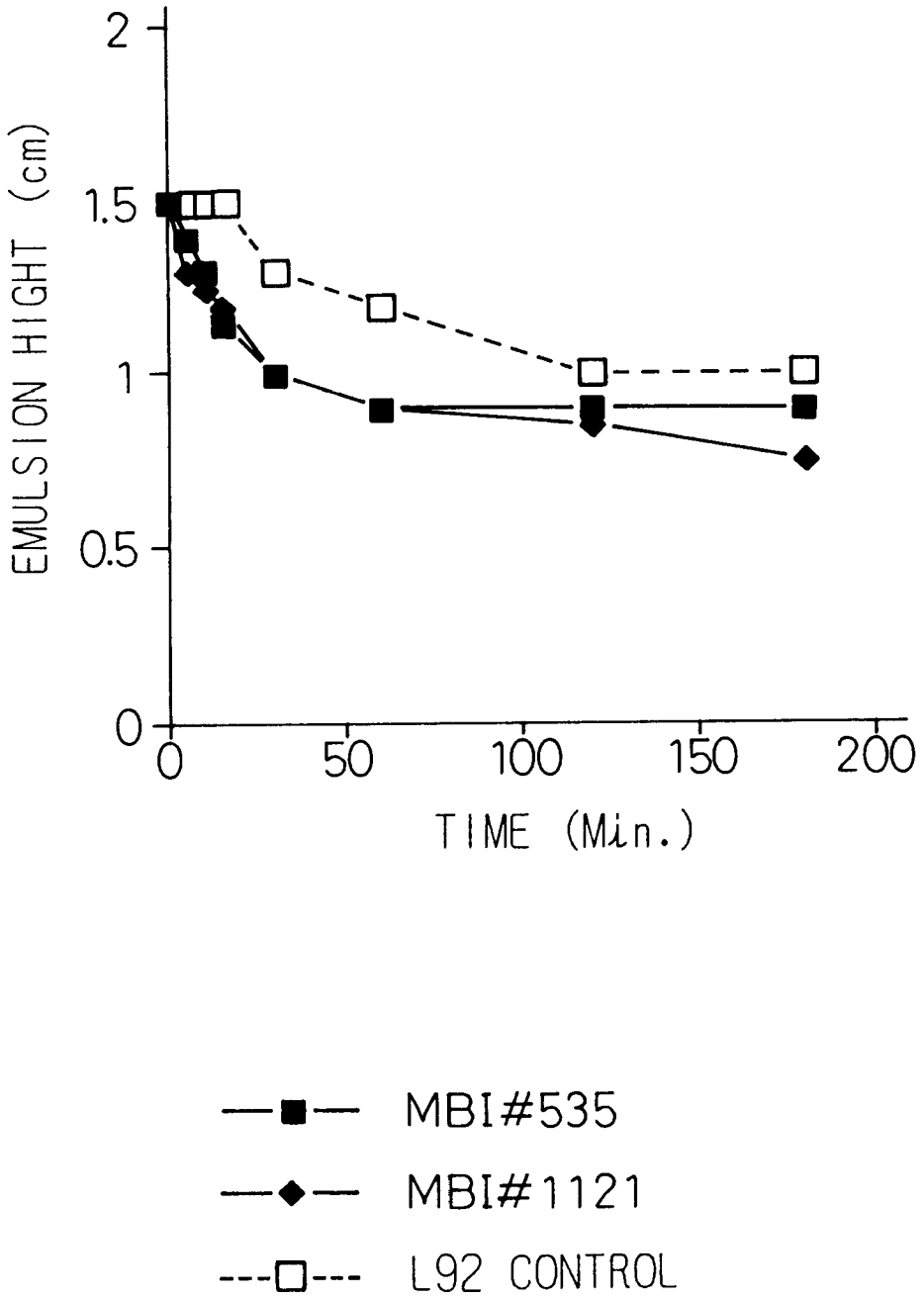
FIG. 2 is a graph showing the time course of demulsificaiton of L92 emulsion by strains of the present invention.

Demulsification activity of strains MBI #535 and MBI #1121 was tested as follow. The two types of kerosene emulsions described in Example 1 were prepared, and 200 μl of culture (containing bacterial cells and liquid) following 1 to 2 days of culturing of each strain at 30° C. were added to each emulsion. The height of the emulsion layer was measured over time. Based on these results, MBI #535 and MBI #1121 exhibited potent activity on the T/S emulsion in the case of adding an equal amount of culture, while break activity on the L92 emulsion was exhibited weaker than on the T/S emulsion. Those results are shown in FIGS. 1 and 2.

In expressing a break activity as a length of time required for the emulsion height to decrease by half (t(½)), for the strain #535 that exhibits the strongest break activity against the T/S emulsion, the t(½) value was approximately 5 minutes at an amount of 50 ppm of culture. The t½ value for strain #1121 was also as short as about 10 minutes. On the basis of these findings, it became clear that these bacterial strains possess powerful activity that breaks emulsions using a small amount of bacterial cells and in a short time. Based on these results, it was found that strains MBI #535 and MBI #1121 are effective for T/S emulsions.

These results are shown in the following Table 3. Furthermore, strain IGTS8 was used for a control (strain negative for break activity).

TABLE 3

Demulsification Activity

| Strain Name | Demulsification Activity* T/S Emulsion (min.$^{-1}$) | Demulsification Activity* L92 Emulsion (min.$^{-1}$) |
|---|---|---|
| #535 | 12.5 | 1 |
| #1121 | 6.5 | 1 |
| Negative break activity strain | 0 | 0 |

*Demulsification activity = 1/t(½) sample − 1/t(½) control [min.$^{-1}$]

Figure 3:
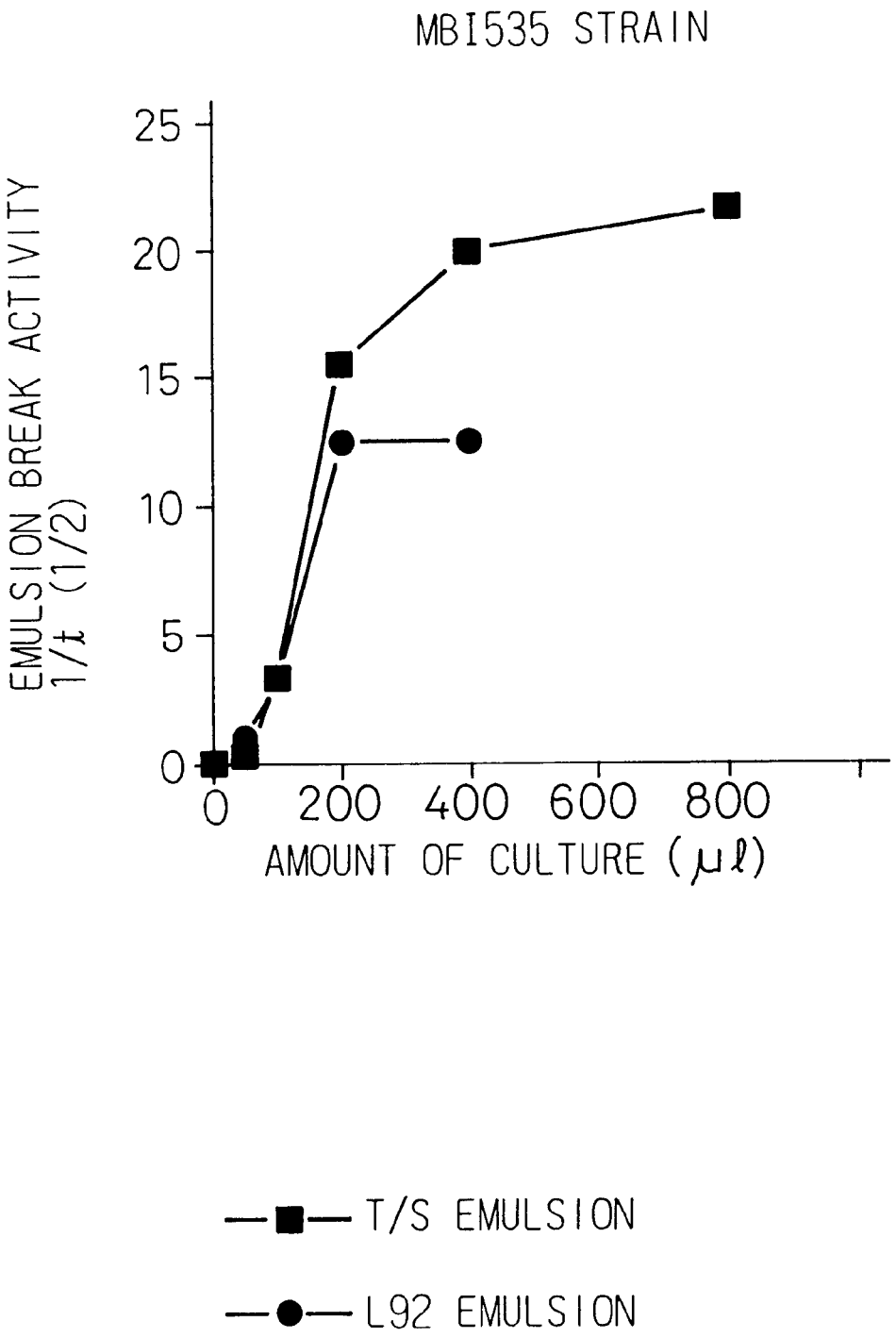
FIG. 3 is a graph showing the effect of an amount of a culture of the present invention MBI #535 on demulsification of T/S and L92 emulsions.

Next, demulsification activity was measured while varing an amount of a culture used of MBI #535. The results are shown in FIG. 3. Based on the results investigated for amounts up to 800 μl, break activity increases with increasing amounts of culture for each strain.

EXAMPLE 3

Demulsification Activity of Alteromonas Species

Figure 4:
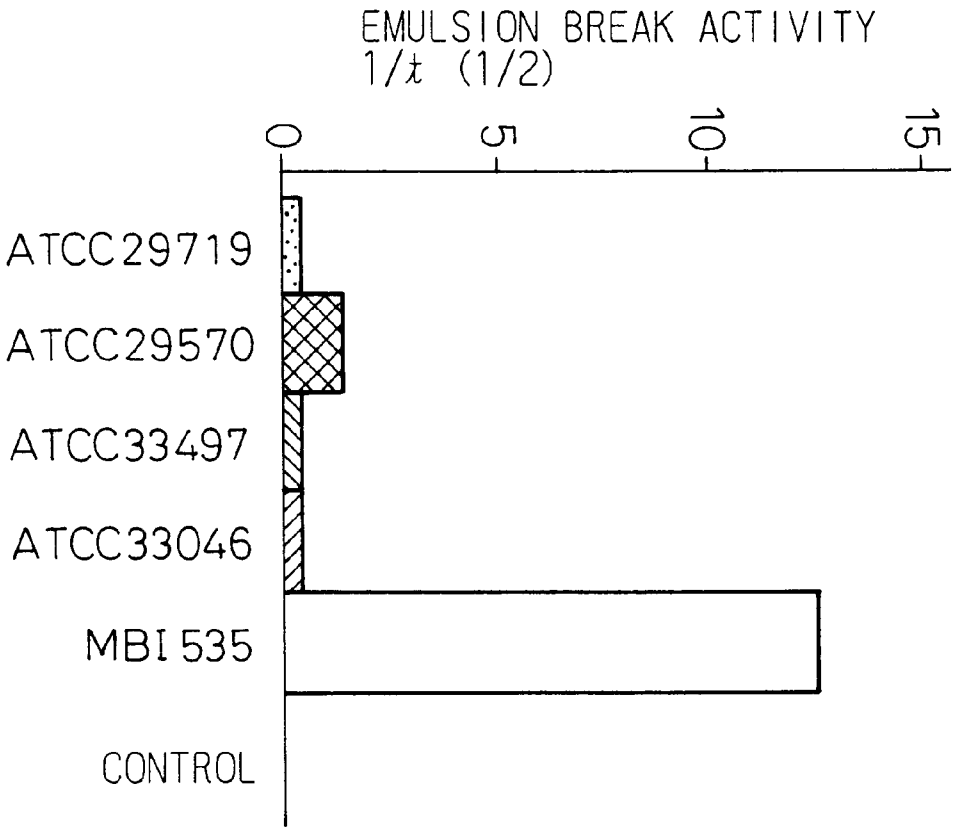
FIG. 4 is a graph showing a comparison of the present invention MBI #535 and the type strains of the genus Alteromonas.

Alteromonas strain MBI #535 along with four other strains (the type strains) of bacteria belonging to the genus Alteromonas (acquired from ATCC) were tested for demulsification activity. The test was performed according to the method described in Example 2. Those results are shown in FIG. 4. Namely, all of the type strains of Alteromonas species tested possessed demulsification activity although so much weaker than that of MBI #535.

EXAMPLE 4

Demulsification of Crude Oil Desalter Emulsion

200 μl of a culture resulting from culturing the above-mentioned bacterial strains for 1 to 2 days at 30° C. were added to a water in oil type (W/O type) model desalter emulsion from a crude oil refining process, prepared by mixing 5 ml of crude oil with an equal amount of topper condensed water. The mixture was heated at 40° C. and separation of the aqueous layer and oil layer was observed for 5 hours. In the case of adding bacterial strains MBI #535 and MBI #1121, demulsification occurred, with the emulsion being divided into a crude oil layer and aqueous layer. 10 ppm of Nalco 5537J, a known demulsifier, was used for comparison purposes. MBI #535 and MBI #1121 were observed to demonstrate greater effects than 10 ppm of Nalco 5537J. On the other hand, separation did not occur or only occurred after a long time (several hours or more) in the case of the control in which nothing was added. Those results are shown in Table 4.

TABLE 4

Demulsification of a Desalter Emulsion

| Strain | Break Activity* [min.$^{-1}$] |
|---|---|
| MBI #535 | 6.25 |
| MBI #1121 | 6.25 |
| Nalco 5537J | 4 |

*Break activity: 1/t(½) sample − 1/t(½) control [min.$^{-1}$]

EXAMPLE 5

Demulsification

Figure 5:
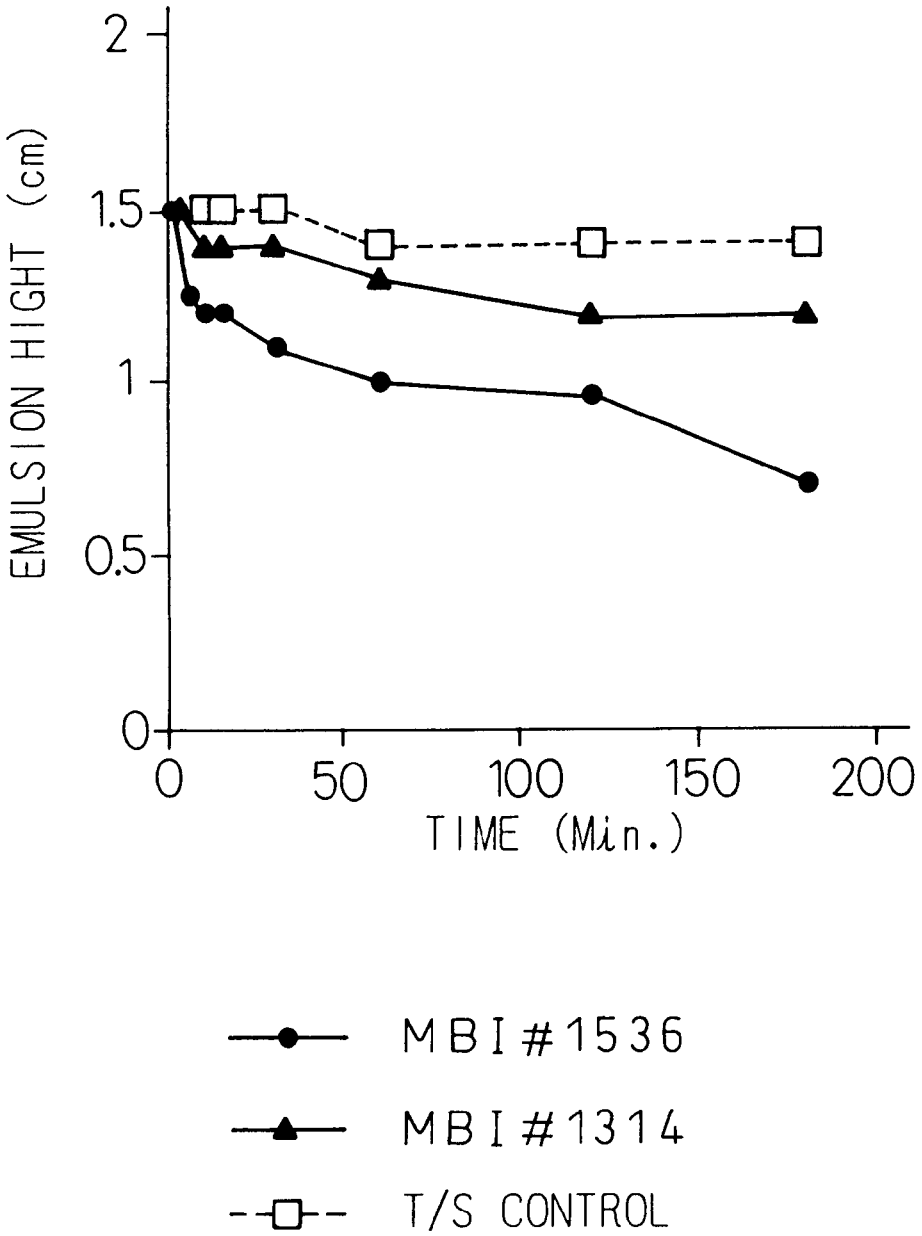
FIG. 5 is a graph showing the time course of demulsification by MBI #1314 and MBI #1536 strains of the present invention.
Figure 6:
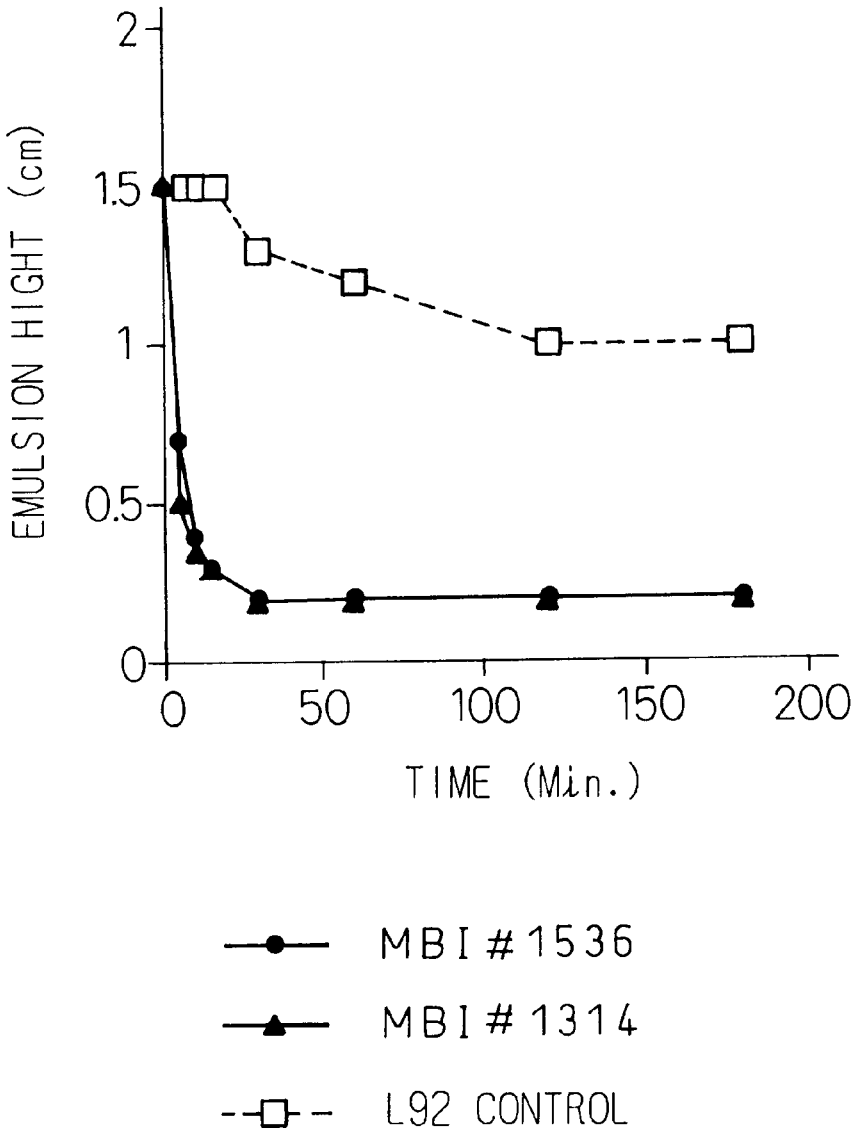
FIG. 6 is a graph showing the time course of demulsification by MBI #1314 and MBI #1536 strains in L92 emulsion.

Demulsification activities of strains MBI #1314 and MBI #1536 were tested as follow. Two types of kerosene emulsions were prepared as described in Example 1 and 200 μl of culture (containing bacterial cells and liquid) of each strain following culturing at 30° C. for 2 days were respectively added to each emulsion. On the basis of those results, in the case of adding an equal amount of bacteria, MBI #1314 and MBI #1536 exhibited a high degree of activity against the L92 emulsion, while break activity against the T/S emulsion was weaker than that of the L92 emulsion. Those results are shown in FIGS. 5 and 6.

In expressing a break activity as a length of time required for the height of the emulsion to decrease by ½ (t(½)), the demulsification activities of MBI #1314 and MBI #1536 against the L92 emulsion were nearly identical, with t(½) for 200 μl of culture liquid being as short as about only 5 minutes. Based on these findings, it became clear that these bacterial strains possess powerful activity to break emulsions in a short time while only using a small amount of bacterial cells.

In addition, on the basis of these results, it was determined that strains MBI #1314 and MBI #1536 are effective in breaking L92 emulsions.

Those results are shown in Table 5. Furthermore, IGTS8 was used for a control (strain negative for break activity).

TABLE 5

Demulsification Activity

| Strain Name | Demulsification Activity* T/S Emulsion (min.$^{-1}$) | Demulsification Activity* L92 Emulsion (min.$^{-1}$) |
|---|---|---|
| #1314 | 0.06 | 12.5 |
| #1536 | 0.33 | 12.5 |
| Negative break activity strain | 0 | 0 |

*Demulsification activity = 1/t(½) sample − 1/t(½) control [min.$^{-1}$]

Figure 7:
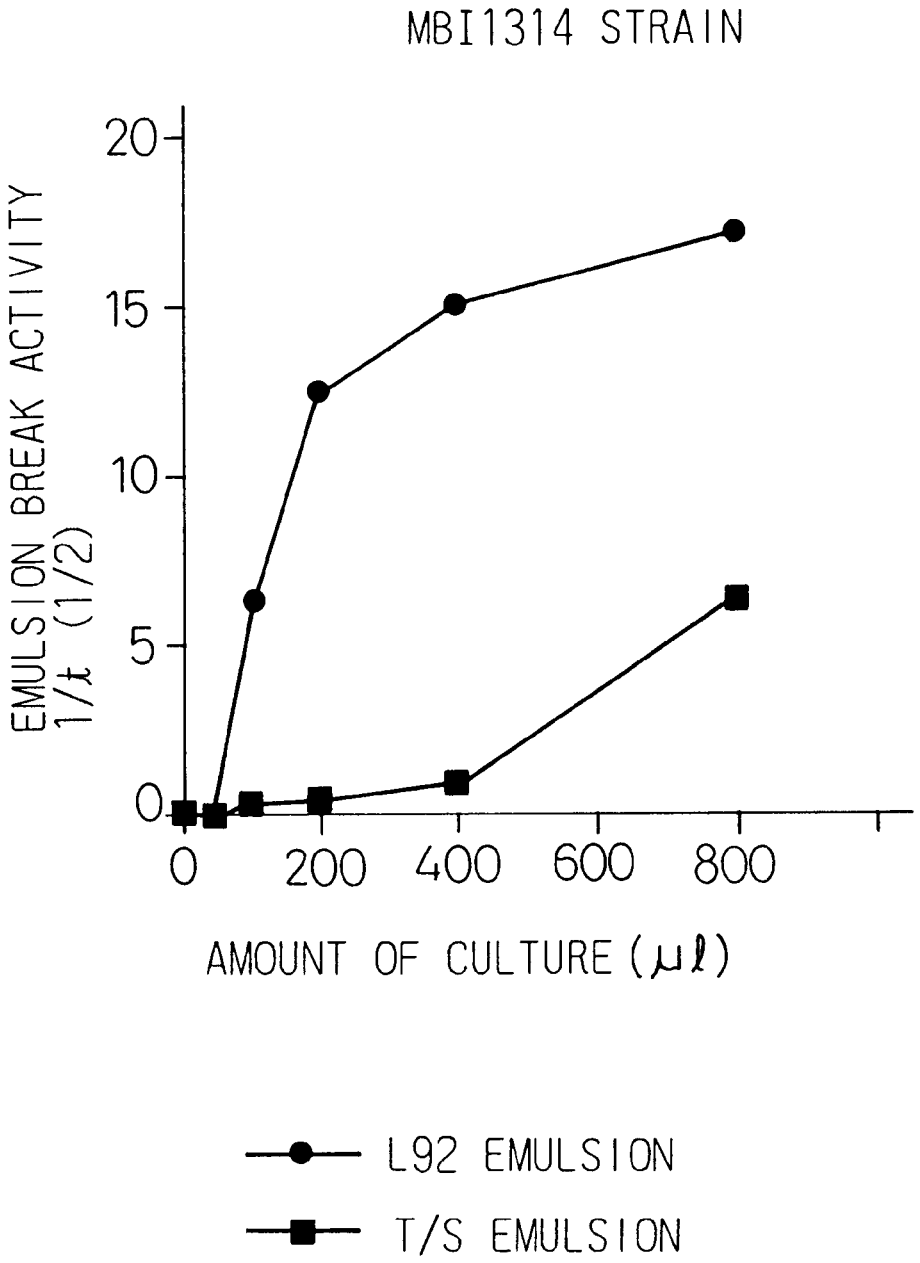
FIG. 7 is a graph showing the effect of an amount of a culture of the present invention MBI #1314 strain on demulsification of T/S and L92 emulsions.

Next, demulsification activity was measured while varing an amount of culture used of MBI #1314. The results are shown in FIG. 7. Based on the results investigated for amounts up to 800 μl, break activity increases with increasing amounts of culture for each strain.

EXAMPLE 6

Demulsification of Crude Oil Desalter Emulsion (Water in Oil Emulsion)

200 μl of a culture resulting from culturing the above-mentioned bacterial strains for 1 to 2 days at 30° C. was added to a water in oil type (W/O type) model of desalter emulsion from a crude oil refining process prepared by mixing 5 ml of crude oil with an equal amount of topper condensed water. The mixture was heated at 40° C. and separation of the aqueous layer and oil layer was observed for 5 hours. In the case of adding bacterial strains MBI #1314 and MBI #1536, demulsification occurred, with the emulsion being divided into a crude oil layer and aqueous layer. On the other hand, separation did not occur or only occurred after a long time (several hours or more) in the case of the control in which nothing was added. Those results are shown in Table 6.

TABLE 6

Demulsification of a Desalter Emulsion

| Strain | Break Activity* [min.$^{-1}$] |
|---|---|
| MBI #1314 | 1.33 |
| MBI #1536 | 0.5 |

*Break activity: 1/t(½) sample − 1/t(½) control [min.$^{-1}$]

EXAMPLE 7

Isolation of Microorganisms Possessing Demulsification Ability

Sludge was sampled from a return sludge tank in an ordinary activated sludge process in oil refining plant and inoculated into an aqueous solution containing synthetic emulsion waste water, which is a model of a waste water emulsion from plants of dust control industry (1.833 g of surfactant (6% anionic surfactant, 3% non-ionic surfactant and 3% bi-ionic surfactant) in 1 liter of distilled water), 0.1 g of KCl, 1 g of $(NH_4)_2SO_4$, 0.02 g of $FeCl_3.6H_2O$, 0.2 g of $MgCl_2.6H_2O$, 0.01 g of $CaCl_2$ and 3 g of spindle oil, followed by culturing continuously for 2 months at an oil, load of 0.5 g/day/liter to acclimatize the activated sludge.

After preparing an agar plate (surface area: 63.5 cm$^2$) by adding 1.5% agar to the above-mentioned synthetic emulsion waste water, the above-mentioned acclimatized activated sludge was applied to the plate and cultured for 1 week at 30° C. A large number of colonies formed as a result of this culturing. Eight colonies were isolated from the colonies that differed in macroscopic form. These colonies were named W1 through W8. Strains W2, W3 and W8 were selected since growth was relatively rapid on the above-mentioned emulsion medium.

Each of these three strains was mixed with the above-mentioned synthetic waste water emulsion, the mixture was shaken overnight at 30° C., and change in turbidity (A660) was measured before and after shaking. As a result, turbidity and turbidity decrease rate (%) after shaking, 292 (0%) for strain W2, 77 (81.9%) for strain W3, 290 (0%) for strain W8 and 230 (0%) for the control (uninoculated) were obtained. Thus, one of the three strains, namely strain W3, possessed demulsification ability.

When this strain W3 was cultured on an LB agar plate, solid cream-colored colonies and somewhat transparent cream-colored colonies appeared. These were respectively named strain W3C and strain W3T. These two strains were identified according to Bergey's Manual of Systematic Bacteriology. The results are shown in Table 7.

TABLE 7

| Bacterial Strain | W3C | W3T | *Aeromonas hydrophila* type strain |
|---|---|---|---|
| Gram staining | − | − | − |
| Morphology | Rods | Rods | Rods |
| Motility | + | + | + |
| Aerobic growth | + | + | + |
| Anaerobic growth | + | + | + |
| Oxidase production | + | + | + |
| Catalase production | + | + | + |
| O/F test | F | F | F |
| $H_2S$ production | − | − | − |
| Esculin hydrolysin | + | + | + |
| Phenylalanine deaminase | − | − | − |
| Indole production | + | + | + |
| Voges-Proskauer test | + | + | + |
| Citric acid utilization | − | − | |
| Lysine decarboxylase | − | − | + |
| Arginine hydrolase | + | + | + |
| Ornithine decarboxylase | − | − | − |
| β-galactosidase production | + | + | + |
| Urease production | − | − | − |
| Malonic acid decomposition | − | − | − |
| Acid formation | | | |
| Adonitol | − | − | − |
| Inositol | − | − | − |
| Raffinose | − | − | − |
| Rhamnose | − | − | − |
| Sorbitol | − | − | − |
| Sucrose | + | + | + |
| Mannitol | + | + | + |
| L-arabinose | + | + | + |

According to the above results, strains W3C and W3T were both identified as *Aeromonas hydrophila*. These bacterial strains were deposited on May 17, 1995 at the Institute of Bioengineering and Human Technology, Agency of Industrial Science and Technology as FERM P-14925 and FERM P-14926, respectively. Furthermore, the above-mentioned microorganisms *Aeromonas hydrophila* W3C (FERM P-14925) was transferred as FERM BP-5558 and *Alteromonas hydrophila* W3T (FERM P-14926) was transferred as FERM BP-5559 to international deposits under the Budapest Treaty on June 5, 1996 at the National Institute of Bioscience and Human-Technology Agency of Industrial Science and Technology.

EXAMPLE 8

Effect of pH on Demulsification Ability

Figure 8:
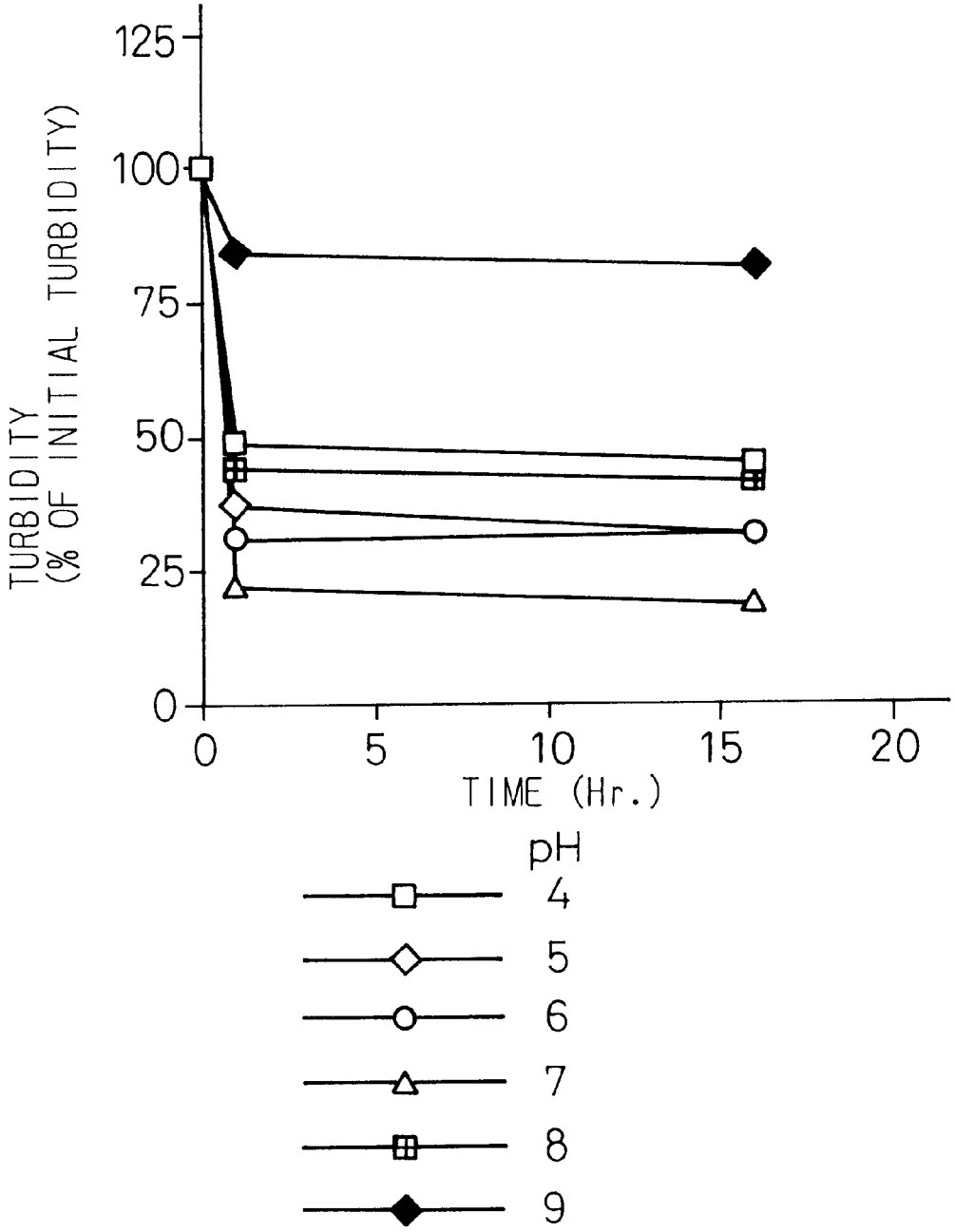
FIG. 8 is a graph showing an effect of pH on demulsification of a model of emulsified waste water by the present invention W3C strain.

Esso cutting oil, kutwell 40 was added at 0.3% (w/w) to MP buffer (containing 2.75 g of $K_2HPO_4$, 2.25 g of $KH_2PO_4$, 1 g of $(NH_4)_2SO_4$, 0.1 g of NaCl and 0.02 g of $FeCl_3.6H_2O$ in 1 liter), emulsified water was prepared, and the emulsion was adjusted to pH 4 to 9. 4 ml of this buffer was placed in test tubes, followed by the addition of 12.5 ppm of the live bacterial cells obtained by culturing strain W3C or W3T overnight in LB medium. These mixtures were shaken by hand for 10 seconds and then allowed to stand undisturbed for 16 hours. During that time, changes in turbidity with respect to initial turbidity (A660) were measured over time. Those results are shown in FIG. 8. As is clear from these results, the bacterial strains of the present invention exhibited demulsification activity over a broad range from acidity to alkalinity extending from pH 4 to pH 8.

EXAMPLE 9

Effect of Amount of Bacterial Cells on Demulsification

Figure 9:
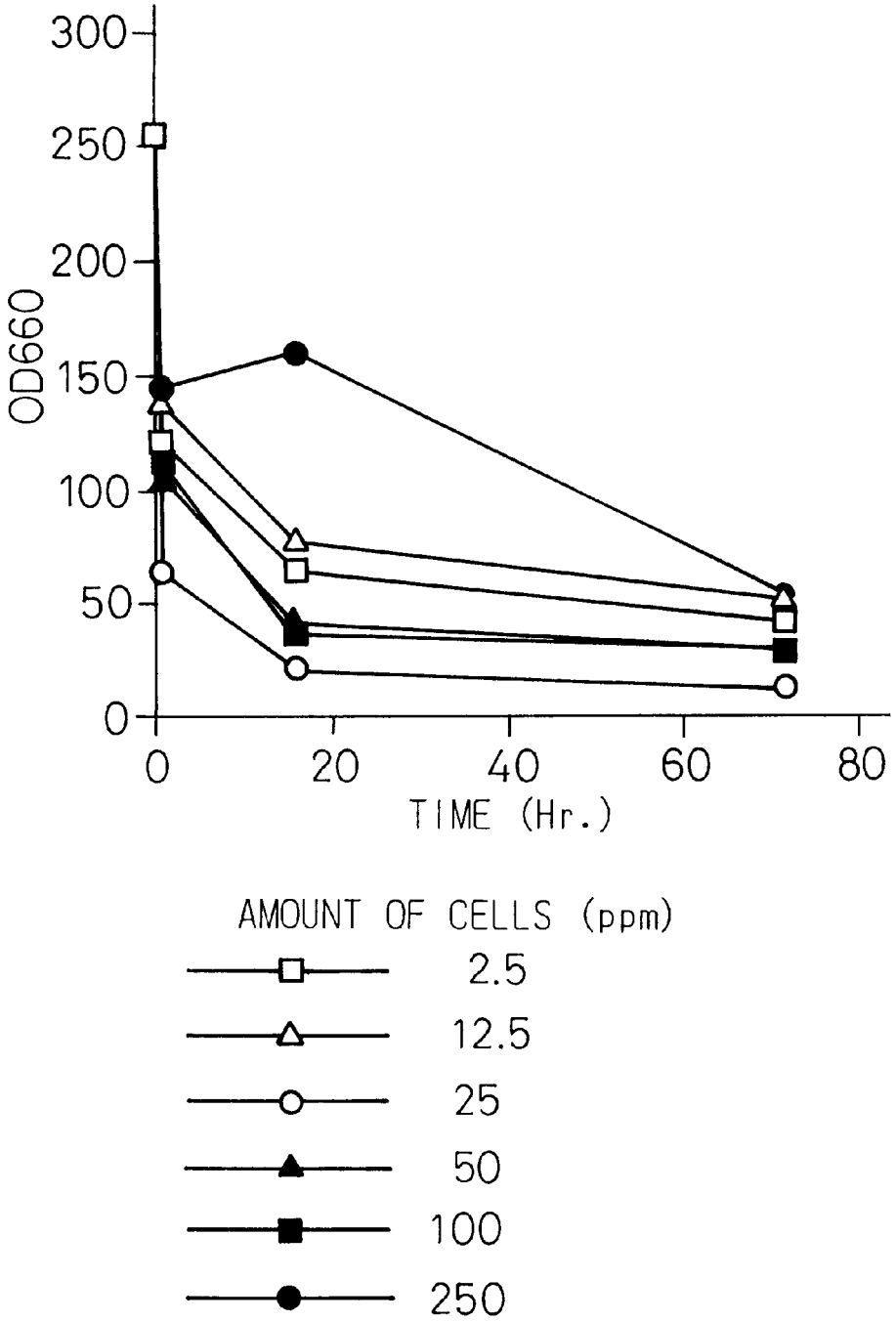
FIG. 9 is a graph showing the effect of an amount of bacterial cells of the present invention W3C strain on demulsification of a model of emulsified waste water (0.3% oil w/w).
Figure 10:
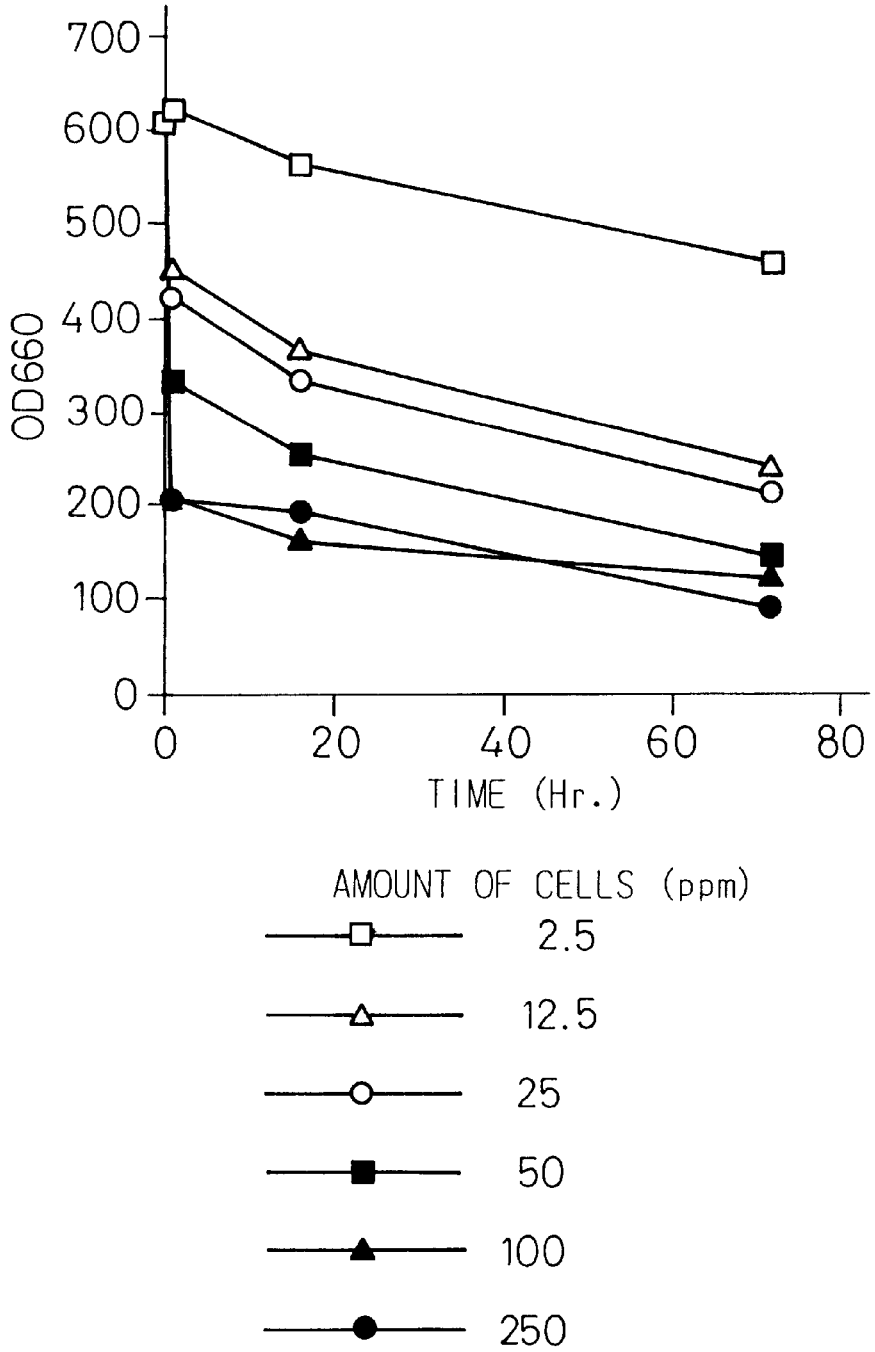
FIG. 10 is a graph showing the effect of an amount of bacterial cells of the present invention W3C strain on demulsification of a model of emulsified waste water (3% oil w/w).

Esso cutting oil Kutwell 40 was added at 0.3% (w/v) or 3% (w/v) to MP buffer (containing 2.75 g of $K_2HPO_4$, 2.25 g of $KH_2PO_4$, 1 g of $(NH_4)_2SO_4$, 0.1 g of NaCl, 0.02 g of $FeCl_3.6H_2O$, 0.01 g of $CaCl_2$ and 0.2 g of $MgCl_2.6H_2O$ in 1 liter) to form an emulsion. 4 ml aliquot of this emulsion was placed in test tubes, followed by the addition of 2.5 ppm to 250 ppm of the live bacterial cells of W3C or W3T cultured overnight in LB medium. After shaking by hand for 10 seconds, the mixtures were allowed to stand undisturbed for approximately 72 hours. The progress of demulsification was then observed by measurement of optical absorbance (OD 660). The results are shown in FIGS. 9 and 10. The minimum required amount of bacterial cells differed depending on an amount of oil in the emulsion, and it was found that the required amount of bacterial cells increased as the amount of oil increased.

EXAMPLE 10

Figure 11:
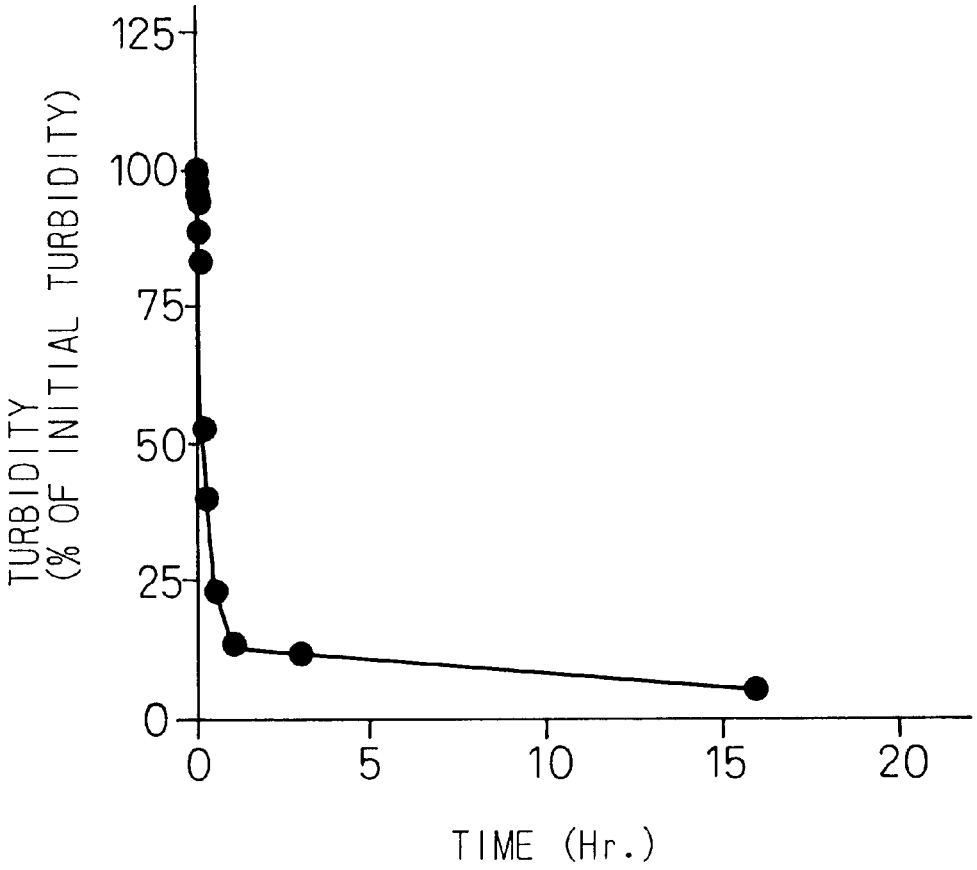
FIG. 11 is a graph showing the time course of demulsification of a model of emulsified waste water emulsion by a bacterium of the present invention W3C strain.

Treatment of Model Waste Water from a Dust Control Plant 4 ml of a model waste water from a dust control plant (composition: 1.833 g of surfactants, 0.1 g of KCl, 1 g of $(NH_4)_2SO_4$, 0.02 g of $FeCl_3.6H_2O$, 0.2 g of $MgCl_2.6H_2O$, 0.01 g of $CaCl_2$, 3 g of spindle oil and 1 liter of distilled water) was placed in a test tube, followed by addition of 25 ppm of bacterial cells of strain W3C cultured overnight in LB medium. After stirring well and then allowing to stand undisturbed, demulsification was observed by measuring the decrease in turbidity for 16 hours. The results are shown in FIG. 11.

After 10 minutes, the turbidity decreased to approximately 50% of the initial turbidity, and decreased to approximately 10% of the initial turbidity after 60 minutes. According to macroscopic observations, the emulsion had separated into a transparent aqueous layer as the bottom layer and an oil/bacterial cell aggregated fraction as the top layer, and the latter further separated into oil droplets and bacterial cells. For an emulsion prior to treatment (raw water), an aqueous transparent fraction after layer separation, as well as a mixture after separation of the bottom aqueous transparent fraction and floating oil portion, the oil concentration and carbohydrate concentration contained therein were examined using the carbon tetrachloride extraction method (oil concentration), determination of hydrocarbon concentration (TOC measurement method), and extraction with n-hexane in accordance with JIS standards.

Figure 12:
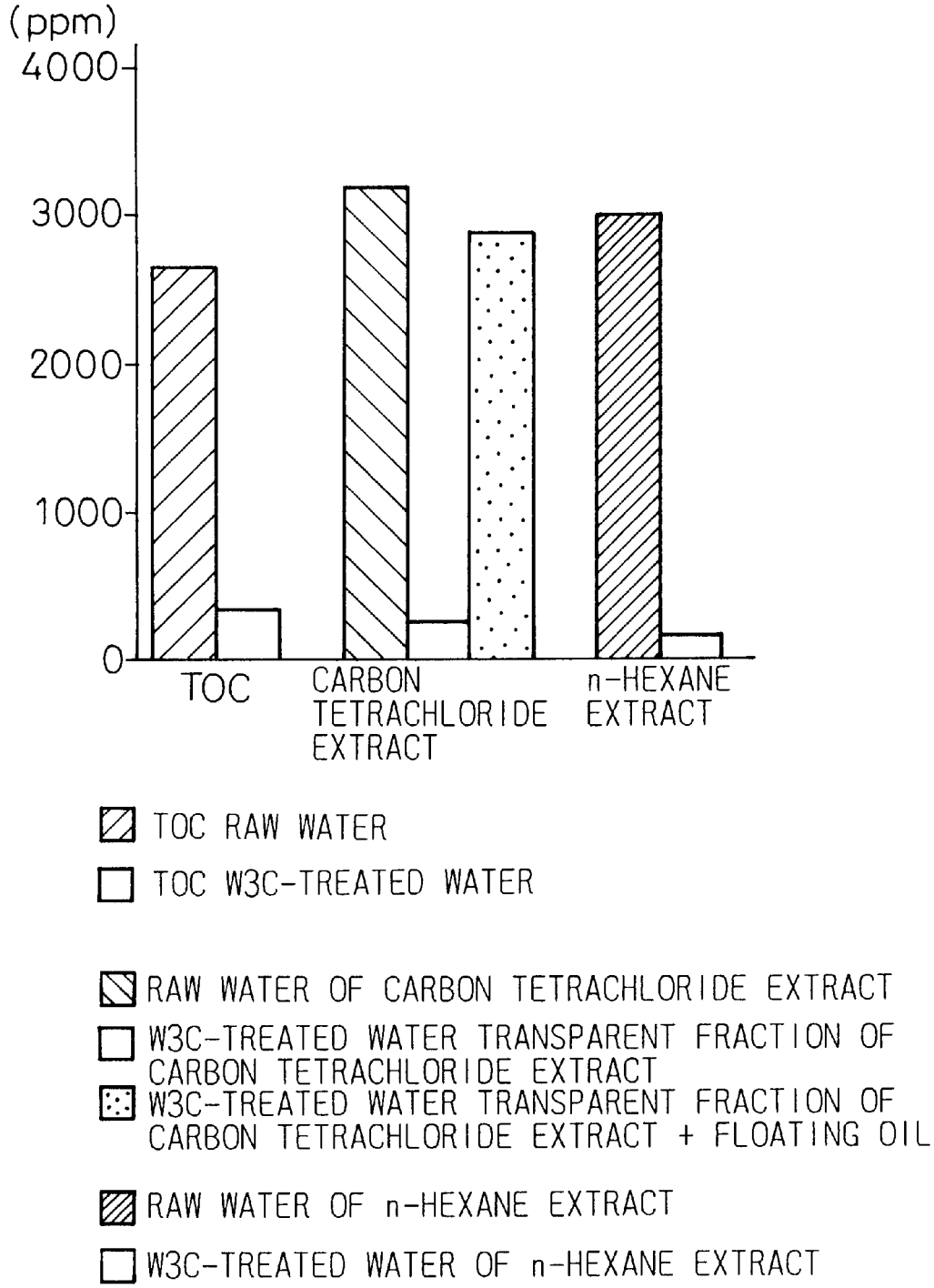
FIG. 12 is a graph showing the removal of oil from an aqueous layer in a model waste water emulsion following demulsification by the present invention W3C strain.

The results are shown in FIG. 12. As is clear from this graph, the oil (or hydrocarbons) in the emulsion before treatment (raw water) was nearly completely removed from the aqueous layer by the treatment of the present invention irrespective of the type of analysis method used.

EXAMPLES 11

Demulsification of Cutting Oil Emulsion

Figure 13:
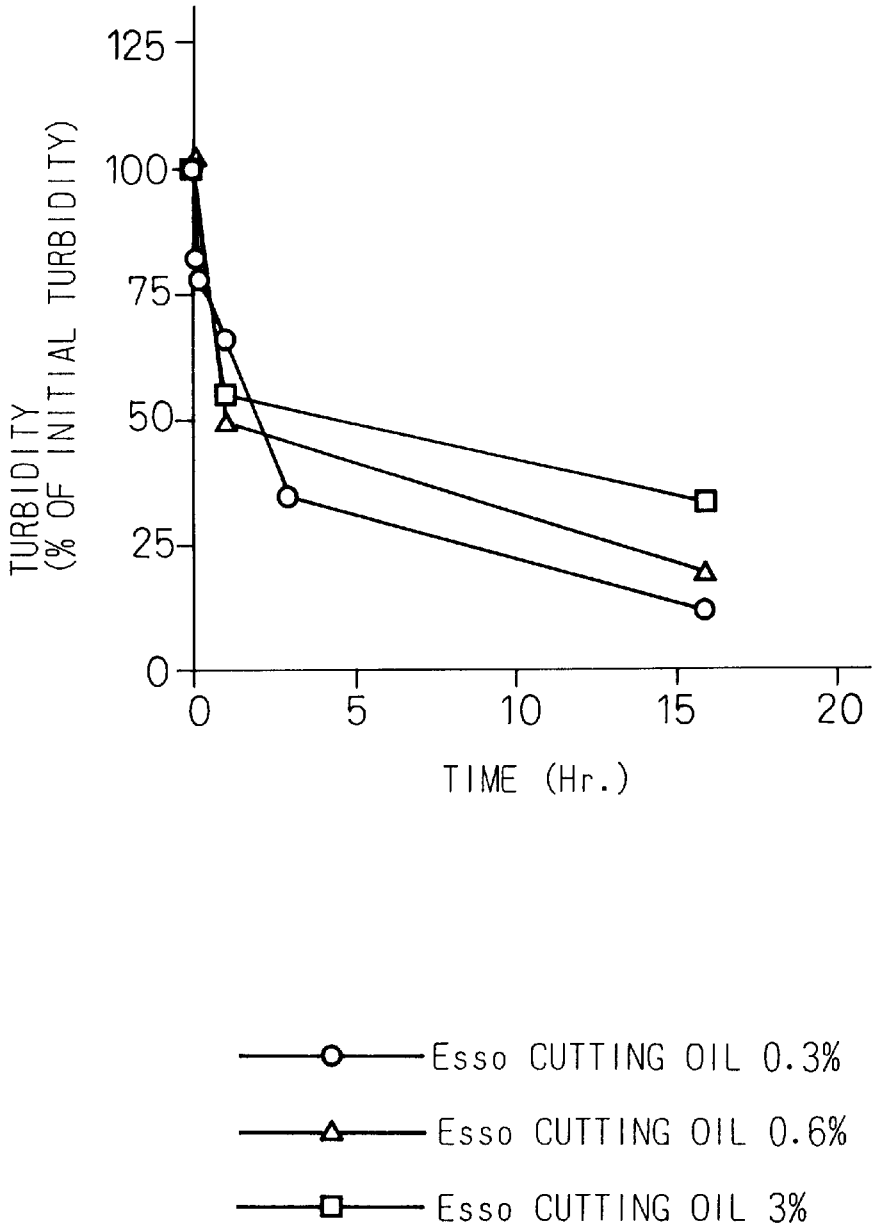
FIG. 13 is a graph showing demulsification of a model of waste water emulsion by a bacterium of the present invention W3C strain with respect to an emulsion of Esso cutting oil.
Figure 14:
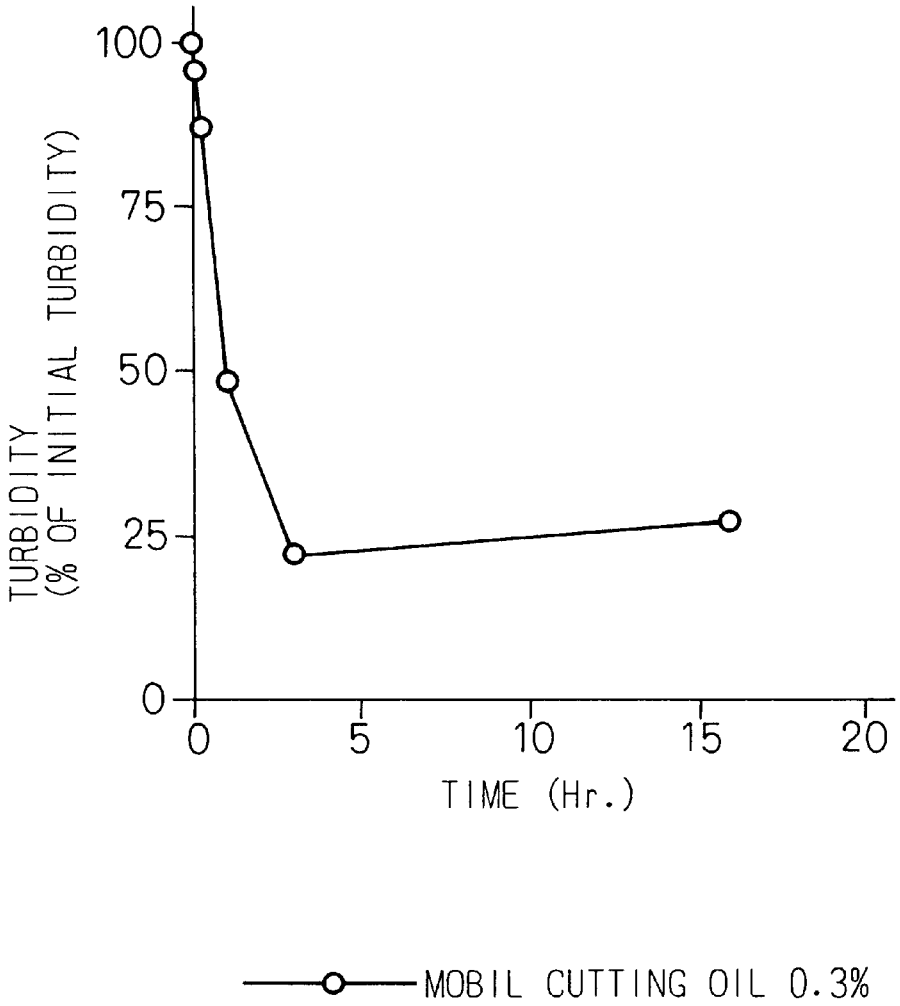
FIG. 14 is a graph showing demulsification of a model of waste water emulsion by a bacterium of the present invention W3C strain with respect to an emulsion of Mobil cutting oil.

Esso Kutwell 40 cutting oil at 0.3%, 0.6% or 3%, or Mobil Solvac 1535G cutting oil at 0.3% was added to MP buffer to respectively form emulsions. 4 ml aliquot of these emulsions were placed in test tubes followed by the addition of 25 ppm of live bacterial cells of strain W3C or strain W3T cultured overnight in LB medium. After shaking well, the mixtures were allowed to stand undisturbed and the turbidity of the liquid was measured for 16 hours over time. The results are shown in FIGS. 13 and 14. In both cases, the emulsions separated into a transparent bottom aqueous layer and a floating oil layer in the same manner as in Example 10.

EXAMPLE 12

Demulsification of Anionic Hydraulic Press Oil Emulsion

Figure 15:
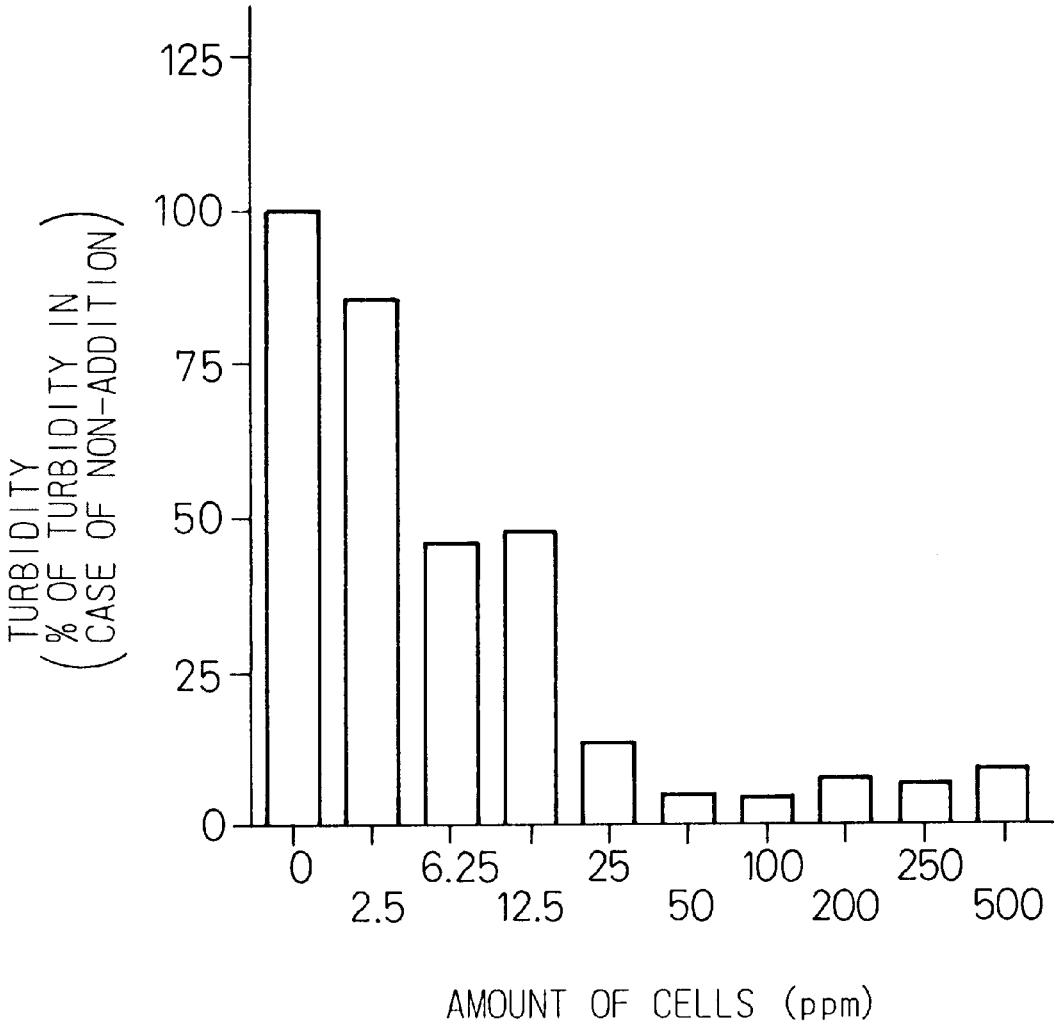
FIG. 15 is a graph showing an effect of amount of bacterial cells of the present invention W3C strain on demulsification of a model of waste water emulsion of anionic hydraulic press oil.

A 3% (w/v) emulsion of anionic hydraulic press oil BKK 202L (oil component 54.6% (w/w), surfactant 25% (w/w) and water 20% (w/w)) was prepared as described in Example 5, and testing was performed in the same manner as Example 11. Similar results were obtained. However, the results shown in FIG. 15 were obtained by changing the amount of cells.

EXAMPLE 13

Demulsification of Crude Oil Emulsion

Figure 16:
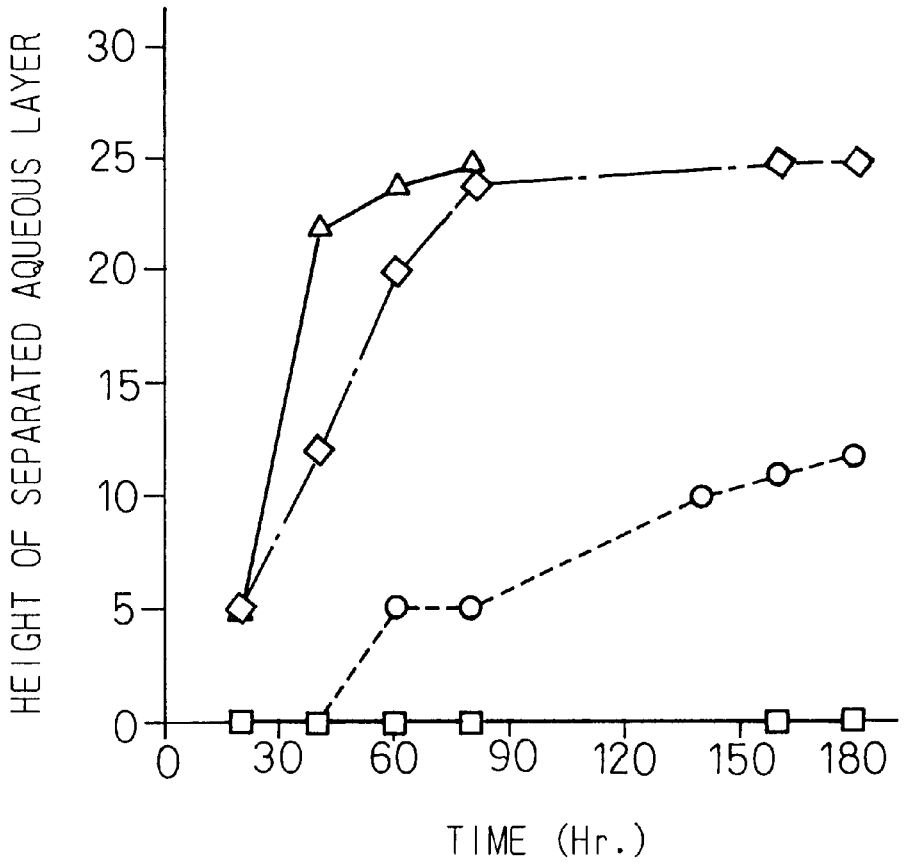
FIG. 16 is a graph showing demulsification of a model of desalter emulsion by a bacterium of the present invention W3C strain.
Figure 16:
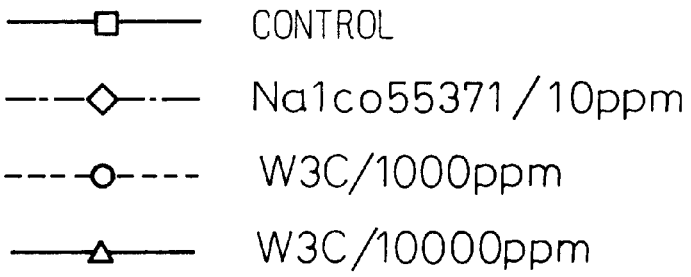

Strain W3C was added to a model desalter emulsion from a crude oil refining process prepared by mixing crude oil with an equal amount of topper condensed water. After heating at 40° C., the emulsion was observed to separate into an aqueous layer and oil layer. Demulsification occurred as a result of adding W3C, and the emulsion separated into two layers, ie.l., of a crude oil layer and aqueous layer. The height of the separated aqueous layer increased in proportion to the amount of bacterial cells, and effects at 10000 ppm were observed that equal to or greater than 10 ppm of a chemical demulsifier (Nalco 5537J). On the other hand, separation did not occur in the case of control in which nothing was added. Those results are shown in FIG. 16.

EXAMPLE 14

Construction of a Continuous Treatment Process for Model Waste Water from a Dust Control Plant Model waste water from a dust control plant was continuously mixed with W3C or W3T cells continuously cultured at a retention time of 24 hours using a medium containing glucose for the carbon source. Moreover, pressurized water was injected into the mixed liquid by a pressurizing floating separation tester to conduct a pressurized floating separation test. The retention time in the reaction tank was set to 1 hour, the amount of bacterial cells injected into the liquid was 50 ppm, the pressurized water pressure was 4 $kg/cm^2$, the pressurized water mixing ratio was 30% and the standing time after injection of pressurized water was 10 minutes. A turbidity clarification rate of roughly 80% and oil removal rate of roughly 80% were demonstrated through the 4th day of continuous culturing starting from inoculation of bacteria. In addition, the evaluation results of this continuous system closely coincided with evaluation results previously obtained using test tubes.

EXAMPLE 15

Comparison with Inorganic Coagulant (PAC) in Model Waste Water from a Dust Control Plant W3C bacteria or PAC (polyaluminium chloride) was added into 500 ml of model waste water from a dust control plant, followed by jar testing. The resulting solution was transferred to a pressurizing floating separation tester to conduct a pressurized floating separation test. An amount of bacterial cells injected into the liquid was 50 ppm, the amount of PAC injected into the liquid was 5,000 ppm, amount of polymer flocculant injected was 2 ppm, and the coagulation pH was 6.0 to 6.5. In contrast to the oil removal rate of PAC being 90%, the oil removal rate of the W3C bacterium was 81%, thus indicating nearly identical results at only 1/100 the injected amount.

EXAMPLE 16

Demulsification of Waste Waters from Plants

Various types of waste water from plants were obtained from plants and demulsification by strain W3 was confirmed. 50 ppm of cells of strain W3 was added to the waste water from plants described in Table 19. After mixing for 10 minutes and allowing to stand undisturbed for 30 minutes, the rate of decrease in turbidity was indicated as demulsification efficiency. Strain W3 caused demulsification at an efficiency of roughly 50%–70% for all types of emulsions, with both decreased turbidity and sedimentation of aggregated matter being observed. In addition, with respect to waste water from a dust control plant, results were obtained that were equivalent to the break efficiency of the model waste water from a dust control plant described above.

TABLE 8

Demulsification of Waste Waters from Plants by Strain W3

| Sample Name | Plant Name | Break |
|---|---|---|
| Slop Tank Water | Petroleum Refinery | + |
| WW-3 | Same as above | + |
| Waste Water of Dust Control Plant | Dust Control Plant | + |

We claim:

1. A demulsifier comprising bacterial cells or a culture supernatant of a bacterium comprising a biologically pure culture of a microorganism belonging to the genus Alteromonas which is Alteromonas MBI #535 (FERM BP-5560) or Alteomonas species MBI #1121 (FERM BP-5561) capable of breaking emulsions comprising water and oil.

2. A process for breaking an emulsion comprising water and oil, comprising the steps of mixing an emulsion comprising water and oil with a culture, bacterial cells or a culture supernatant of a biologically pure culture of a microorganism selected from the group consisting of Alteromonas species MBI#535 (FERM BP-5560) and Alteromonas species MBI#1 121 (FERM BP-5561).

3. A process for breaking an emulsion comprising water and oil, comprising the steps of:

mixing an emulsion comprising water and oil with cells comprising a biologically pure culture of microorganisms selected from the group consisting of Aeromonas hydrophila W3C FERM BP-5558) and Aeromonas hydrophila W3T (FERM BP-5559), capable of breaking an emulsion comprising water and oil so as to form an aqueous layer and an aggregated layer consisting of bacterial cells and oil; and separating these layers.

4. A demulsifier comprising bacterial cells comprising a biologically pure culture of microorganisms selected from the group consisting of Aeromonas hydrophila W3C (FERM BP-5558) and Aeromonas hydrophila W3T (FERM BP-5559) capable of breaking an emulsion comprising oil and water.

5. A biologically pure culture of a microorganism selected from the group consisting of Aeromonas hydrophila W3C (FERM BP-5558) and Aeromonas hydrophila W3T (FERM BP-5559).

6. A biologically pure culture of a microorganism selected from the group consisting of Alteromonas species MBI #535 (FERM BP-5560) and Alteromonas species MBI #1121 (FERM BP-5561).

* * * * *